US009670046B2

(12) United States Patent
Clüsserath et al.

(10) Patent No.: US 9,670,046 B2
(45) Date of Patent: Jun. 6, 2017

(54) MULTIPLE FILLING ELEMENT FOR A FILLING SYSTEM OR A FILLING MACHINE AND FILLING MACHINE

(71) Applicant: KHS GmbH, Dortmund (DE)

(72) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 5 days.

(21) Appl. No.: 14/420,416

(22) PCT Filed: Apr. 24, 2013

(86) PCT No.: PCT/EP2013/001231
§ 371 (c)(1),
(2) Date: Feb. 9, 2015

(87) PCT Pub. No.: WO2014/023366
PCT Pub. Date: Feb. 13, 2014

(65) Prior Publication Data

US 2015/0217983 A1 Aug. 6, 2015

(30) Foreign Application Priority Data

Aug. 7, 2012 (DE) ..... 10 2012 015 962
Aug. 7, 2012 (DE) ..... 20 2012 007 517 U

(51) Int. Cl.
*B67C 3/22* (2006.01)
*B67C 3/26* (2006.01)
*B67C 3/24* (2006.01)

(52) U.S. Cl.
CPC ..... *B67C 3/225* (2013.01); *B67C 3/244* (2013.01); *B67C 3/26* (2013.01); *B67C 3/2617* (2013.01);
(Continued)

(58) Field of Classification Search
CPC ..... B67C 3/001; B67C 3/005; B67C 3/225; B67C 3/244; B67C 3/26; B67C 3/2617;
(Continued)

(56) References Cited

U.S. PATENT DOCUMENTS 2,813,555 A 11/1957 Fox et al.
3,047,032 A * 7/1962 Carter ..... B67C 3/04 141/149
(Continued)

FOREIGN PATENT DOCUMENTS

GB 2 036 703 7/1980
WO WO2013/029704 3/2013

*Primary Examiner* — Timothy L Maust
*Assistant Examiner* — Andrew Schmid
(74) *Attorney, Agent, or Firm* — Occhiuti & Rohlicek LLP

(57) ABSTRACT

A filling machine includes a multiple filling-element arranged for installation on a circulating rotor. The multiple-filling element includes individual filling-elements, each of which comprises a filling channel. Each filling channel has a dispensing opening, and an independently controllable liquid valve. The filling-element is formed for installation on an underside of a ring bowl provided on a rotor for holding liquid filling-charge. Other function elements are common to all the individual filling-elements. These function elements include controlled fluid paths.

16 Claims, 12 Drawing Sheets

(52) U.S. Cl.
CPC .... *B67C 3/2622* (2013.01); *B67C 2003/2685* (2013.01)

(58) Field of Classification Search
CPC ..... B67C 3/2622; B67C 3/2642; B67C 2003/2685
USPC ..... 141/1, 11, 85–93, 97, 259
See application file for complete search history.

(56) References Cited

U.S. PATENT DOCUMENTS

| | | | | | |
|---|---|---|---|---|---|
| 4,053,003 | A * | 10/1977 | Ferrero | ..... | B67C 3/06 141/144 |
| 5,190,084 | A * | 3/1993 | Diehl | ..... | B67C 3/26 141/286 |
| 2005/0045244 | A1 * | 3/2005 | Hartness | ..... | B67C 3/02 141/144 |

* cited by examiner

MULTIPLE FILLING ELEMENT FOR A FILLING SYSTEM OR A FILLING MACHINE AND FILLING MACHINE

RELATED APPLICATIONS

This application is the national stage entry under 35 USC 371 of PCT/EP2013/001231, filed on Apr. 24, 2013, which claims the benefit of the Aug. 7, 2012 priority date of German applications DE 102012015962.5 and DE 202012007517.9, the contents of which are herein incorporated by reference.

FIELD OF DISCLOSURE

The invention relates to devices for filling containers, and in particular to a multiple filling-element.

BACKGROUND

To simplify the design and control of filling machines for the filling of bottles or similar containers with a liquid charge, it is known to combine two individual filling elements, each forming a processing position, into one multiple filling-element. In this situation, commonly, one part of the function elements necessary for the function of the multiple filling-element is provided separately for the individual filling elements, and a further part of the function elements is provided jointly for the individual filling elements of the multiple filling-element.

SUMMARY

An object of the invention is to provide a multiple filling-element that allows for a further simplification in the design, installation, maintenance, and/or control of the multiple filling-elements and the processing positions formed by these on a filling machine.

The multiple filling-elements according to the invention are complete and fully functional modules or structural units that are easily installed and, if the need arises, easily replaced. The multiple filling-elements according to the invention are also characterized by a very compact and space-saving structural design. In particular, the spatial requirement for multiple-filling elements mounted at a ring bowl of a rotor is very small, and in this situation especially for the parts of the multiple filling-element located outside the ring bowl, such that, with the multiple filling-elements, a very easily overviewed and optimally accessible design arrangement for the filling machine is possible.

In one aspect, the invention features a filling machine that includes a multiple filling-element arranged for installation on a circulating rotor. The multiple-filling element includes individual filling-elements, each of which comprises a filling channel. Each filling channel has a dispensing opening, and an independently controllable liquid valve. The filling-element is formed for installation on an underside of a ring bowl provided on a rotor for holding liquid filling-charge. Other function elements are common to all the individual filling-elements. These function elements include controlled fluid paths.

In another aspect, the invention features an apparatus for filling containers with liquid filling-charge. Such an apparatus includes a multiple filling-element, a circulating rotor, individual filling-elements, filling channels, filling-charge dispensing openings, independently controlled liquid valves, and a ring bowl that forms an interior and that is provided at the rotor to provide the liquid filling-charge. The multiple filling-element is arranged for installation on the circulating rotor and on an underside of the ring bowl. Each one comprises individual filling-elements, each of which has filling channels. Each filling channel has one of the filling-charge dispensing opening and one of the independently controllable liquid valves. Other function elements of the individual filling-elements are common to all individual filling-elements of the multiple filling-element. These other function elements are controlled fluid paths, controlled liquid paths, gas paths, vapor paths, or control valves located on liquid paths, gas paths, or vapor paths.

Embodiments include those in which the multiple filling-element comprises no more than two individual filling-elements. These are sometimes called "double filling-elements."

In other embodiments, the filling-charge dispensing openings, the liquid channels, and valve seats of one of the liquid valves and the function elements are provided in or at a filling-element underpart that is arranged for installation on the underside of the ring bowl.

In other embodiments, the function elements are configured for arrangement in the interior. In these embodiments, the function elements are provided separately or independently for the individual filling-elements.

In yet other embodiments, the liquid valve comprises a valve seat, a valve plunger, and a valve body at the valve plunger. The valve body interacts with the valve seat. The valve plunger is guided in or at an additional housing. The housing is provided separately for each filling element at a filling-element underpart, a side of which projects above the housing and faces away from the filling-charge dispensing opening.

Other embodiments include separate first and second paths, a control valve, and a structure that is either a common connection or a gas channel. The paths are either gas paths or vapor paths. Each of the individual filling-elements of the multiple filling-element comprises one of the paths. In its open state, the control valve connects the first and second paths with the structure. In its closed state, the control valve separates the first and second paths from the structure and from each other. Among these are embodiments in which the control valve comprises a first valve seat, a second valve seat, and a third valve seat. The first valve seat is connected to the first path, wherein the second valve seat is connected to the second path, and the third valve seat is connected to the structure.

Some embodiments further comprise a filling machine having a vertical machine axis. In these embodiments, the circulating rotor is a rotor of the filling machine that rotates about the vertical machine axis. The multiple filling-element is one of a plurality of identical multiple filling-elements disposed along a circumference of the rotor, each of which forms a filling point. Among these are embodiments in which parts of the multiple filling-elements are accommodated in the interior. These include embodiments in which the parts are provided separately for the individual filling-elements, embodiments in which the parts comprise function elements that are provided separately for the individual filling-elements, and embodiments in which each of the multiple filling-elements comprises an underpart, wherein each underpart comprises an independent housing for each individual filling-element of the multiple filling-element, wherein each individual filling-element extends into the interior, wherein further filling channels are formed in the individual filling-elements, wherein the further filling channels are connected to a filling channel in the filling-element underpart, and wherein the further filling channels are connected to the interior via openings.

In yet other embodiments, each of the individually controllable liquid valves comprises a valve body, a valve plunger, a valve seat, and an actuation device. The valve body is provided at the valve plunger, and interacts with the valve seat. The valve plunger extends at least part-way into the interior and connects to the actuation device. The actuation device is provided on an upper side of the ring bowl outside the interior, and enables controlled opening and closing of the liquid valve.

Other embodiments include a spring element between the valve plunger and the additional housing in the interior. The spring element pre-tensions the valve plunger and the valve body into one of a closed and open position of the liquid valve.

Yet other embodiments include a gas channel, an additional valve, and a gas chamber. The gas channel, which is also formed in the ring bowl's interior, is open to the filling-charge dispensing opening and opens into the gas chamber via the additional valve.

Embodiments also include those in which each of the filling points comprises a container-engagement structure and a lifting structure that corresponds to the container-engagement structure. Examples of container-engagement structures include container carriers and centering elements. Examples of lifting structures include both a common lifting device and separate lifting devices. The container-engagement structure is movable along a filling-element axis by the lifting structure.

Other embodiments include those in which each of the individual filling-elements has a probe that is configured to extend into a container during filling thereof for controlling an amount of liquid filling-charge introduced into the container. In some embodiments, the probe comprises a gas tube that extends into a gas channel.

As used herein, "pressure filling" means a filling method in which the container that is to be filled is placed in a tight seal position against the filling element and, as a rule, before the actual filling phase, i.e. before the opening of the liquid valve, is subjected to pre-tension by at least one tensioning gas under pressure (inert gas or CO2 gas respectively) by way of at least one controlled gas channel formed in the filling element, which then, during the filling, is forced by the filling charge flowing into the container, as a return gas, out of the interior of the container, likewise via at least one controlled gas channel formed in the filling element. This pre-tensioning phase can precede further treatment phases, such as evacuation and/or flushing of the interior of the container with an inert gas, e.g. CO2 gas etc., and likewise via gas channels formed in the filling element.

As used herein, a "container placed in a tight seal position against the filling element" means that the container that is to be filled is held with its container mouth pressed tightly against the filling element, or, respectively, against a seal located there and surrounding at least one filling charge discharge opening of the filling element.

As used herein, "containers" includes cans, bottles, tubes, pouches, etc., in each case made of metal, glass, and/or plastic, and other packing media that are suitable for the filling of liquid or viscose products.

As used herein, "multiple filling-elements" refers to filling elements with which at least two, and possibly three or more filling elements are combined to form one function unit and/or module.

As used herein, "essentially" or "approximately" refers to deviations from a respective exact value by ±10%, preferably by ±5% and/or deviations in the form of changes that are not of significance for the function.

Further embodiments, advantages, and application possibilities of the invention can be derived from the following description of exemplary embodiments and from the figures. All features described and/or pictorially represented are in principle the object of the invention, alone or in any desired combination, regardless of their incorporation in the claims or back references made to them. The contents of the claims are also considered a constituent part of the description.

BRIEF DESCRIPTION OF THE DRAWINGS

The invention is explained in greater detail hereinafter on the basis of the figures, relating to an exemplary embodiment in which.

DETAILED DESCRIPTION

Figure 1:
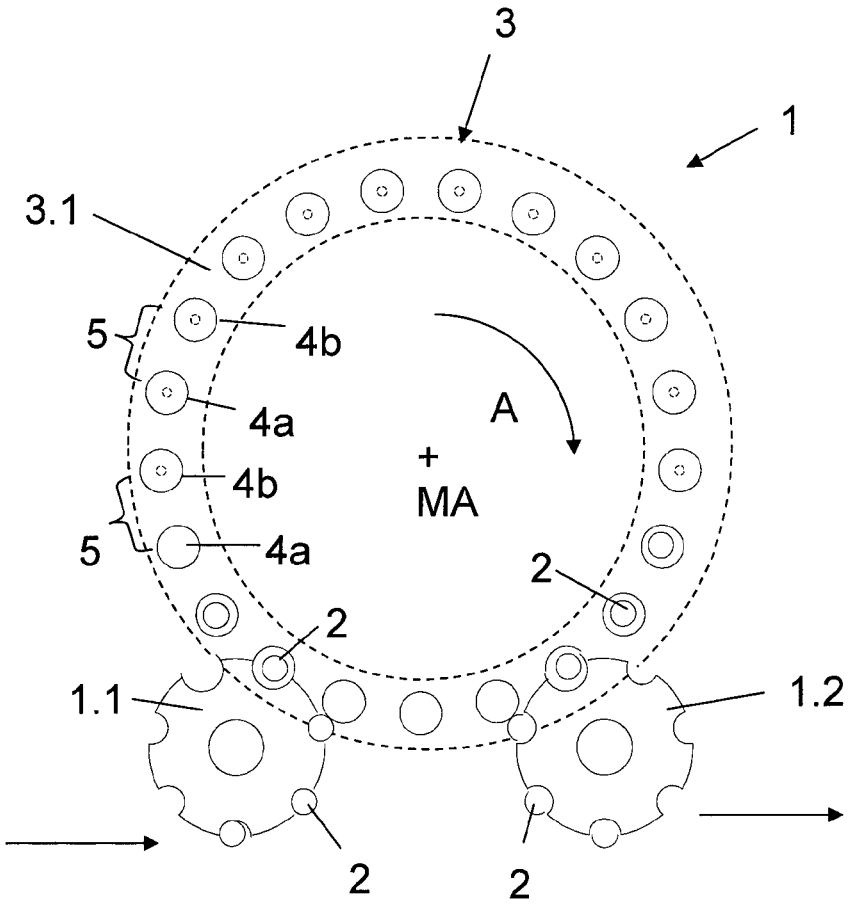
FIG. 1 is a diagrammatic representation of a view from above of a rotating filling machine with a plurality of processing positions provided around a circumferential periphery of a driven rotor that rotates about a machine axis.

FIG. 1 shows a filling machine 1 that fills containers 2, such as bottles, with a liquid filling charge. The filling machine 1 is a rotating machine having a driven rotor 3 that rotates about a vertical machine axis MA in the direction of the arrow A. Processing positions 4*a*, 4*b* are formed along the circumference of the rotor 3. These processing positions 4*a*, 4*b* are distributed at uniform angular distances about the vertical machine axis MA at the same radial distance from the machine axis MA and on the same level. In the rotor's direction of rotation A, a second processing position 4*b* follows a first processing position 4*a*. A first processing position 4*a* then follows each second processing position 4*b*. The containers 2 that are to be filled are conducted to the processing positions 4*a*, 4*b* via a container inlet 1.1. The filled containers 2 are taken up from the processing positions 4*a*, 4*b* at a container outlet 1.2.

A number of multiple filling-elements 5 are provided at the circumference of the rotor 3. These multiple filling-elements 5 are distributed at uniform angular intervals about the machine axis MA, at the same radial distance from the machine axis MA and on the same level. In the illustrated embodiment, each multiple filling-element 5 is a double filling-element.

Figure 3:
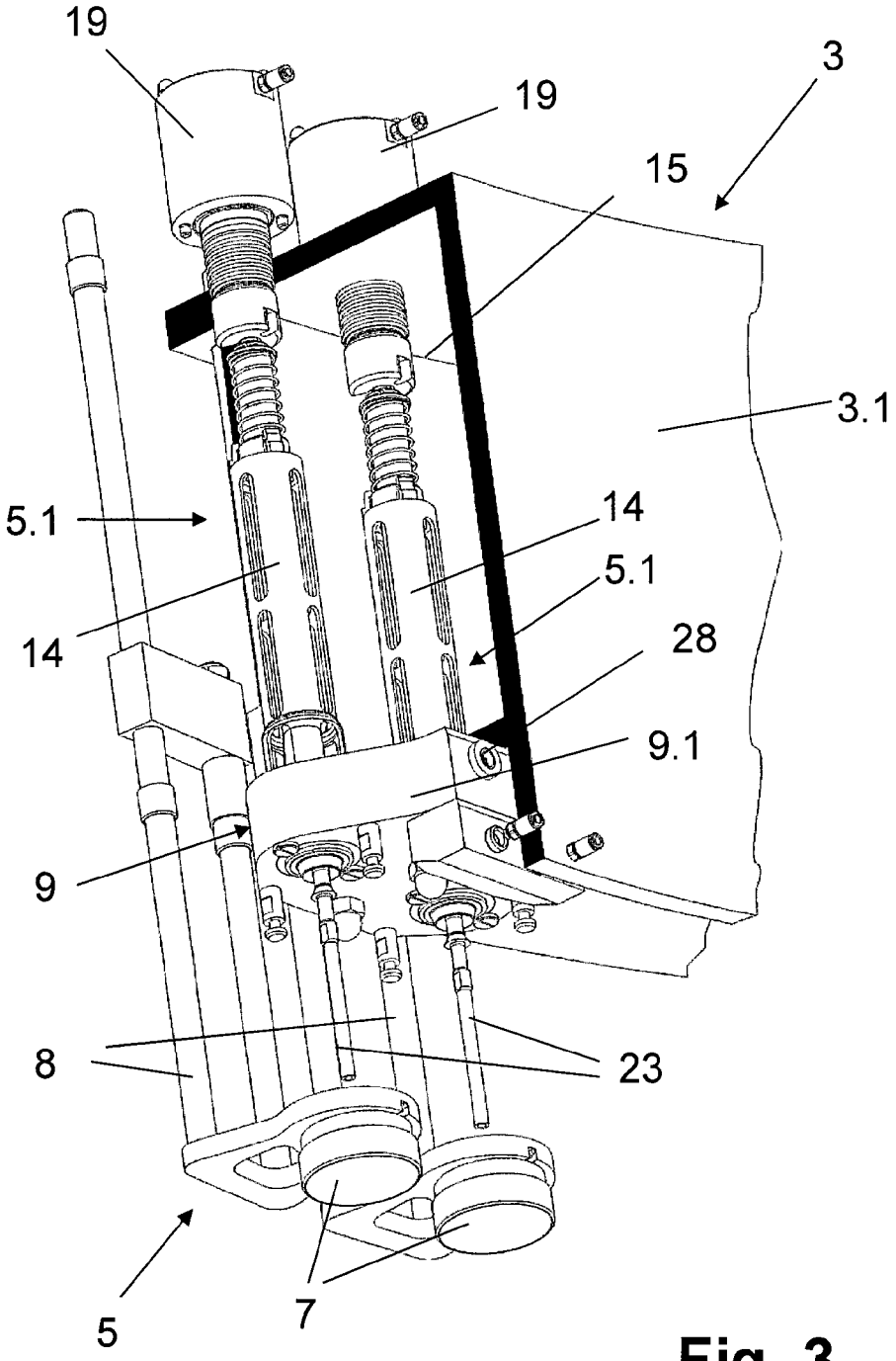
FIGS. 3-5 show different perspective views of the ring-bowl in section together with the multiple filling-element.

As shown in FIG. 3, each multiple filling-element 5 forms two individual filling elements 5.1, one for the first processing position 4*a* and another for the second processing position 4*b*. Each multiple filling-element 5 is a fully-functional pre-fitted module or structural unit that, during the production of the filling machine 1, can be quickly fitted at the rotor 3. In the event of a possible defect or conversion of the filling process, a multiple filling-element 5 can also be quickly replaced.

Figure 2:
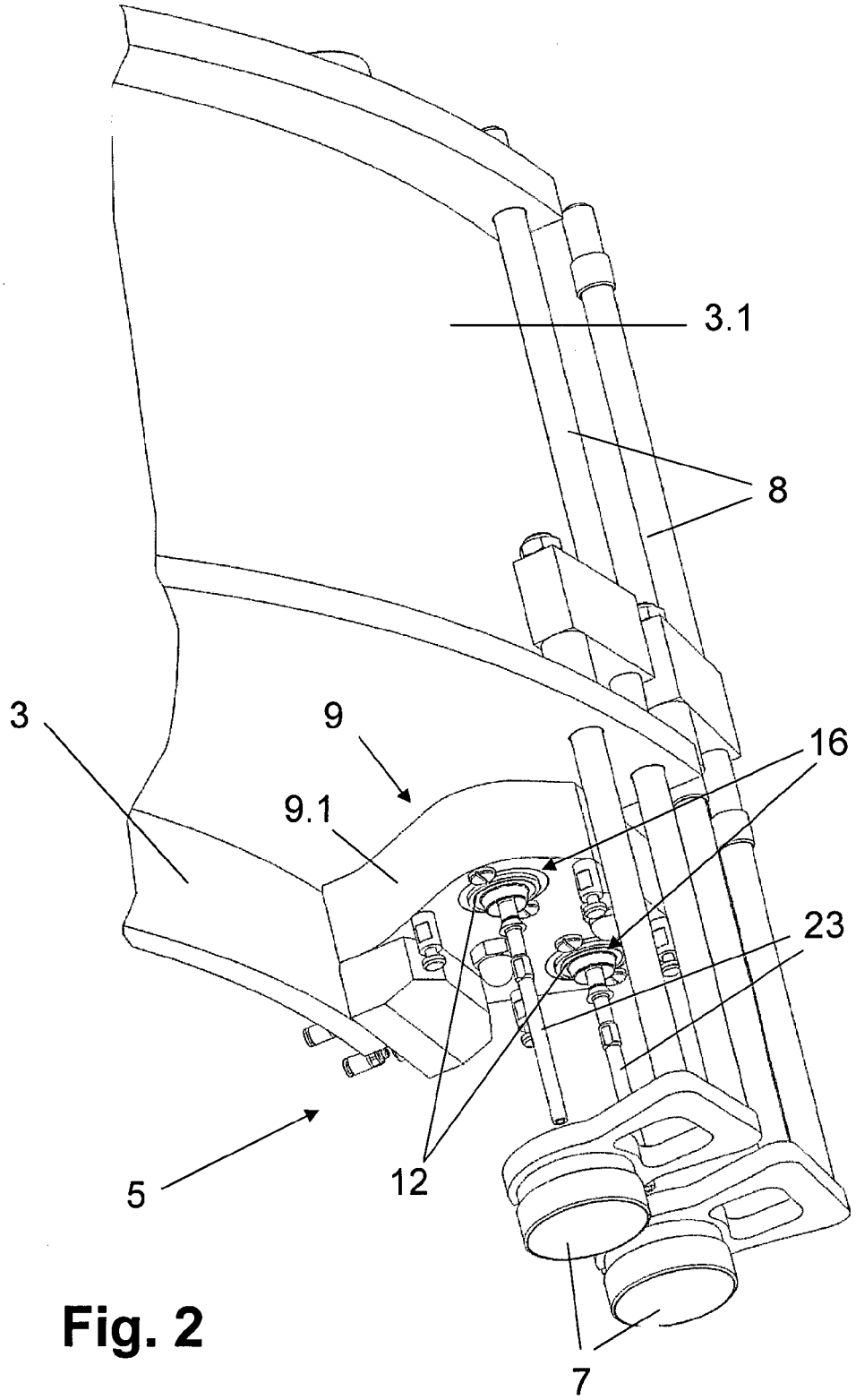
FIG. 2 is a perspective representation, viewed from below, of a ring bowl of the filling machine, together with a multiple filling-element having two individual filling elements forming two processing positions.

Referring now to FIG. 2, each multiple filling-element 5 is mounted on the underside of a ring bowl 3.1, which is a constituent part of the rotor 3. During the filling operation, the ring bowl 3.1 is partially filled with liquid filling charge, and thus provides this filling charge at all the processing positions 4*a*, 4*b*.

Figure 8:
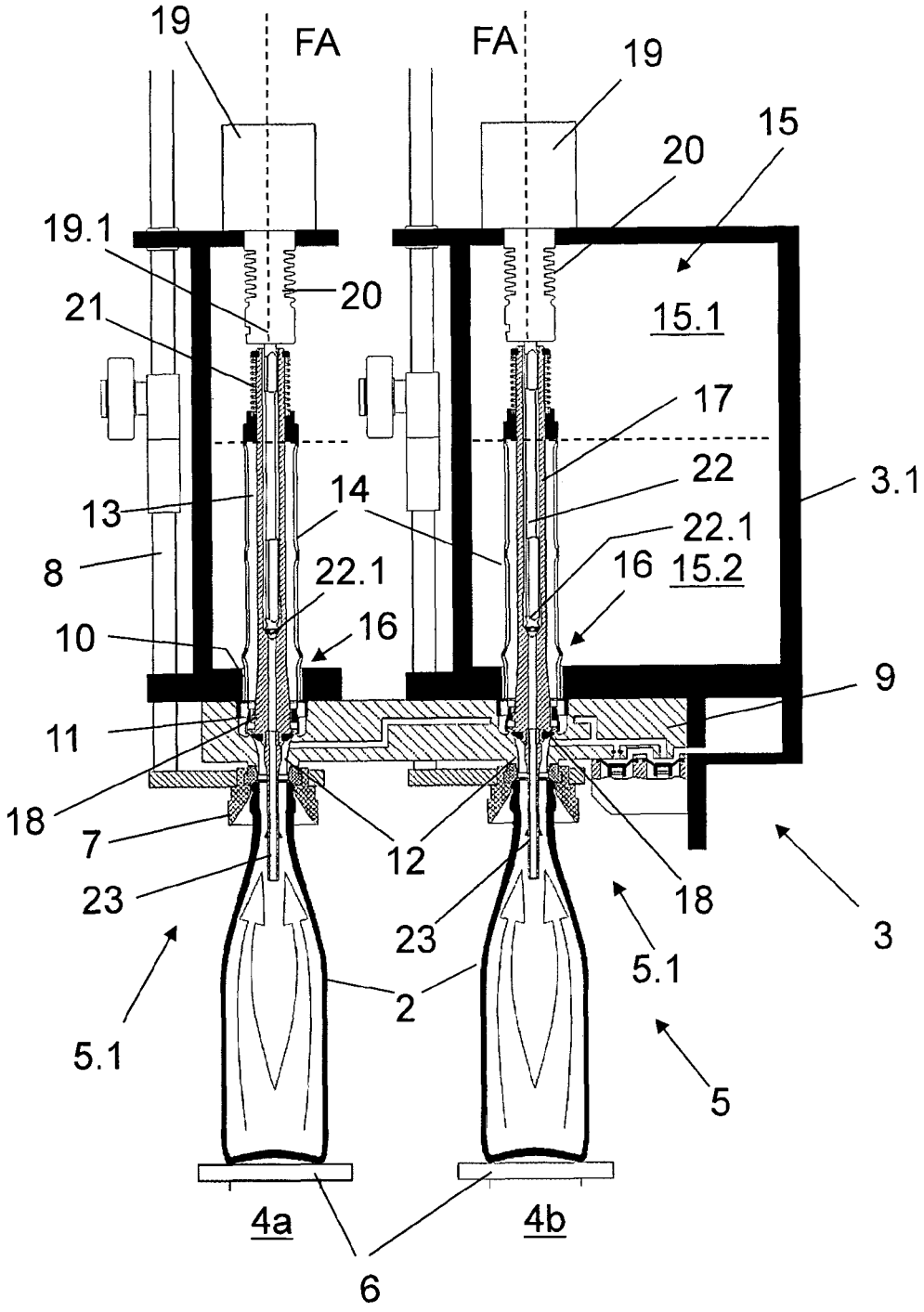
FIG. 8 is a schematic function representation of one of the multiple filling-elements, together with the ring bowl in a sectional view, together with two bottles in the sealing positions at the two processing positions of the multiple filling-element.

Each processing position 4*a*, 4*b* comprises its own container carrier 6, best seen in FIG. 8. A container 2 to be filled stands upright on one of the container carriers 6. A container is said to stand upright when its container axis is coaxial or parallel, or essentially coaxial or parallel, with a vertical filling element axis FA.

During filling, the container 2 is raised so that it is tightly sealed against a multiple-filling element 5. For the two container carriers 6 allocated to a particular multiple filling-element 5, either separate raising elements or a common raising element is provided.

Figure 4:
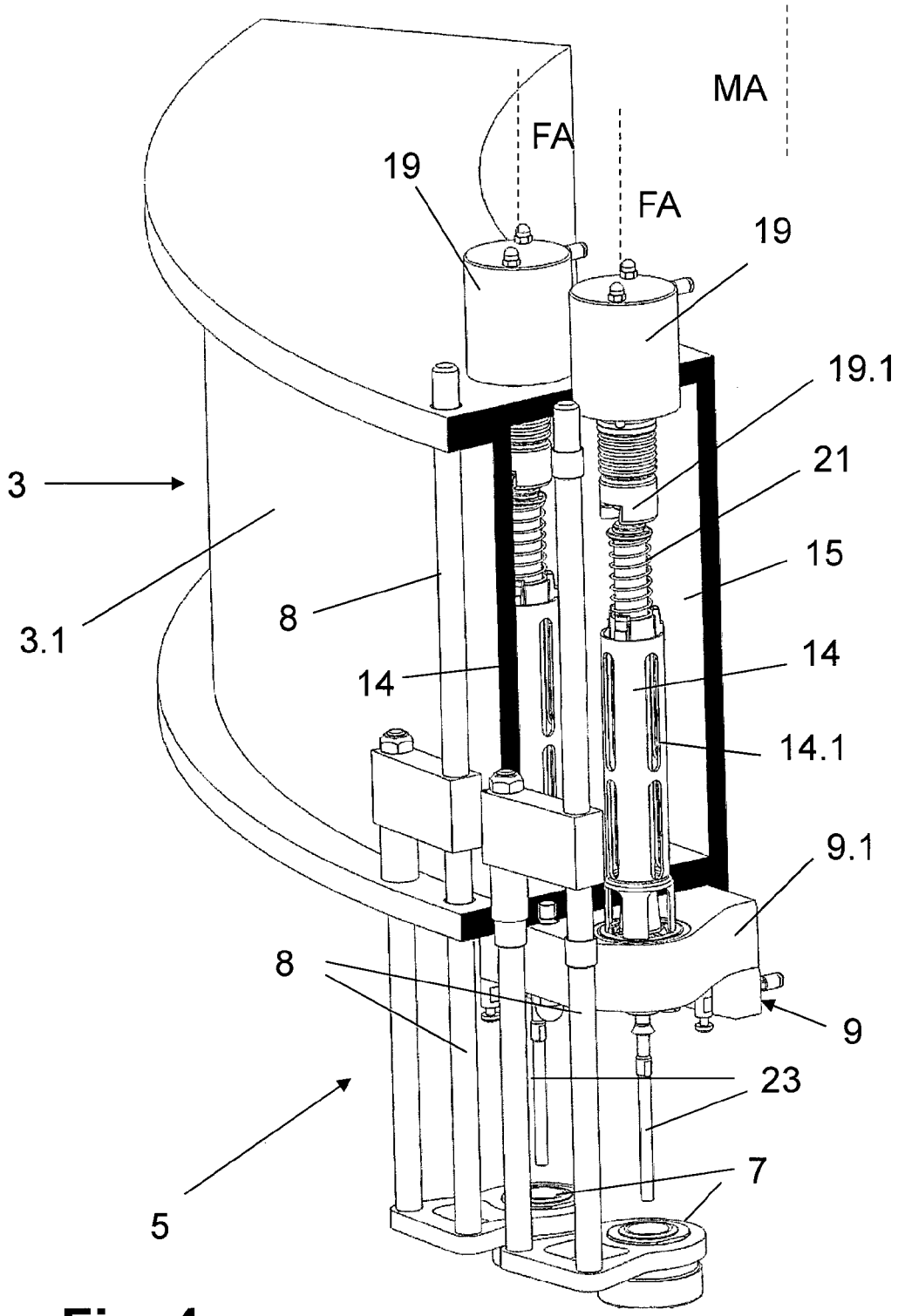
Figure 5:
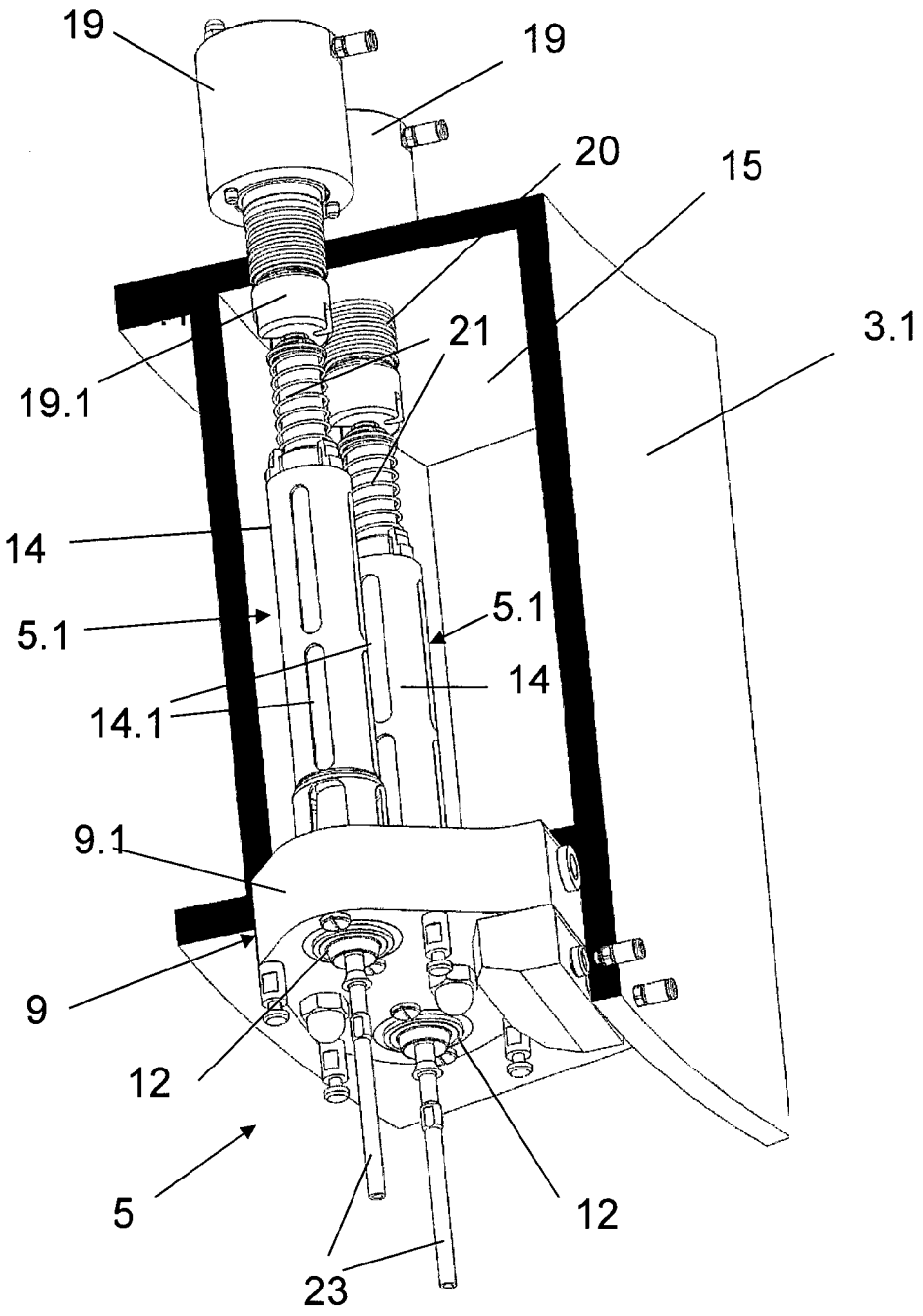
Figure 6:
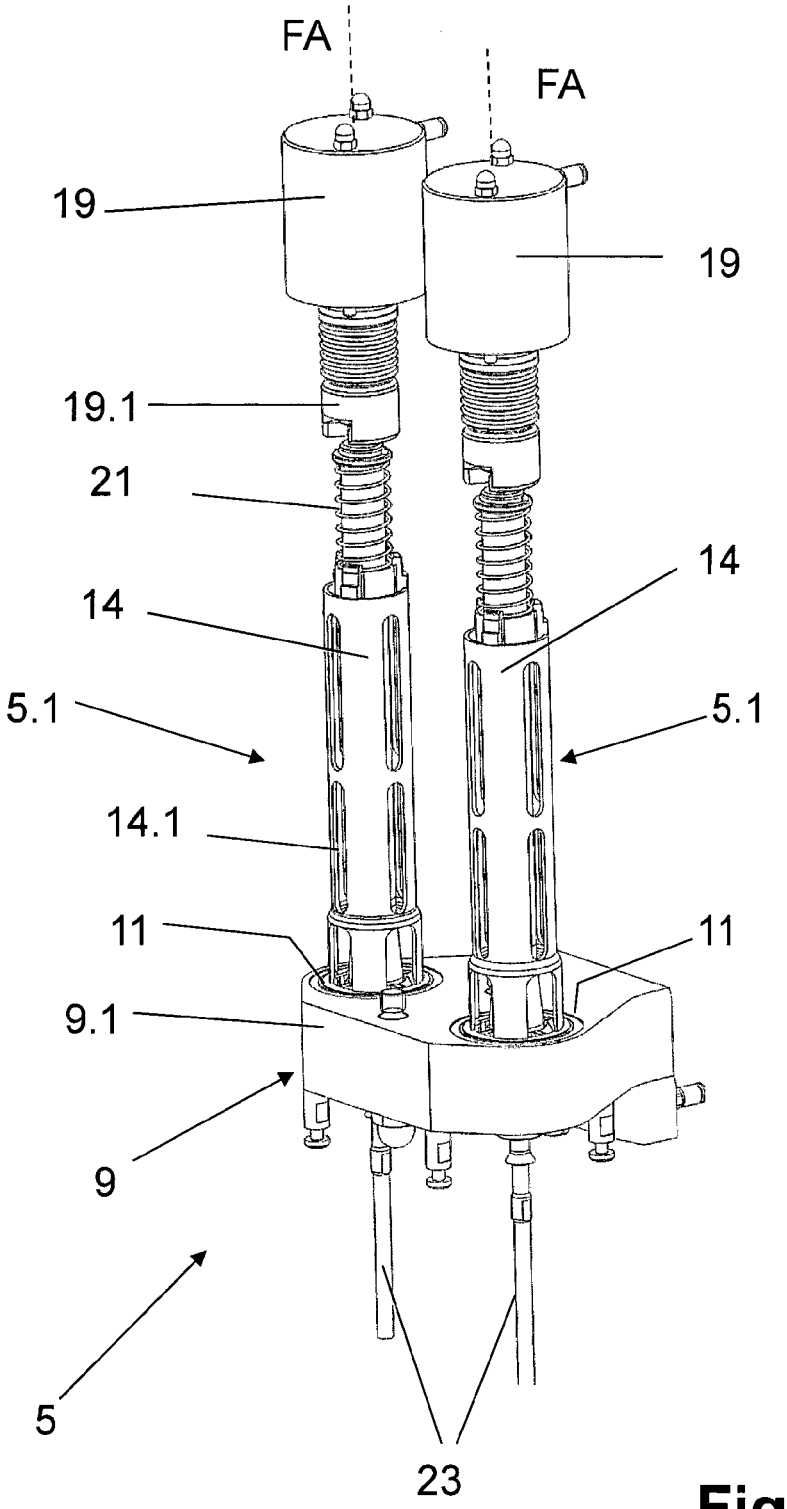
FIGS. 6 and 7 show different perspective views of one of the multiple filling-elements of the filling machine.

In addition, each processing position 4*a*, 4*b* has its own centering element 7, which in each case is provided on a guide rod 8, as shown in FIGS. 3 and 4. As the rotor 3 rotates, the guide rod 8 raises and lowers the centering element 7 in a controlled curve. The centering element 7 comprises at least one ring seal for the sealing position of the raised container 2 at the multiple-filling element 5.

Each multiple-filling element 5 includes a filling-element underpart 9 that is common to both of the individual filling elements 5.1. In the embodiment shown, the filling-element underpart 9 is flat or plate-shaped.

As shown in FIG. 2 and FIG. 8, a flat housing 9.1 is secured to the underside of the ring bowl 3.1 in a suitable manner, for example by bolting. With the use of at least one seal, and specifically in the area of two openings 10, the flat housing 9.1 is provided on an underside or in the base of the ring bowl 3.1.

Formed in the filling element underpart 9 are two first liquid channels 11, which can be seen in FIG. 8. The axial interval between the two first liquid channels 11 is equal to the interval between the processing positions 4*a*, 4*b*. The first liquid channels 11 are arranged on an upper side of the filling element underpart 9, located against the underside of the ring bowl 3, and congruent to an opening 10. In the embodiment shown, the axes of the first liquid channels 11 define a filling element axis FA that is oriented parallel to the machine axis MA of the individual filling element 5.1 or the processing position 4*a*, 4*b* concerned.

On the underside, facing away from the ring bowl 3.1, each first liquid channel 11 forms an annular filling-charge dispensing opening 12. In the sealing position of a container 2 arranged at the multiple filling-element 5, the annular filling-charge dispensing opening 12 connects to the interior of the container 2. During filling, liquid filling charge flows into the container's interior through the annular filling-charge dispensing opening 12.

The first liquid channel 11 continues upwards to a second filling channel 13, which is formed in the interior of a tubular housing 14, which is arranged coaxially with the filling element axis FA. The tubular housing 14 extends into an interior 15 of the ring bowl 3.1, and ends at a distance from the upper side of the ring bowl 3.1.

Figure 7:
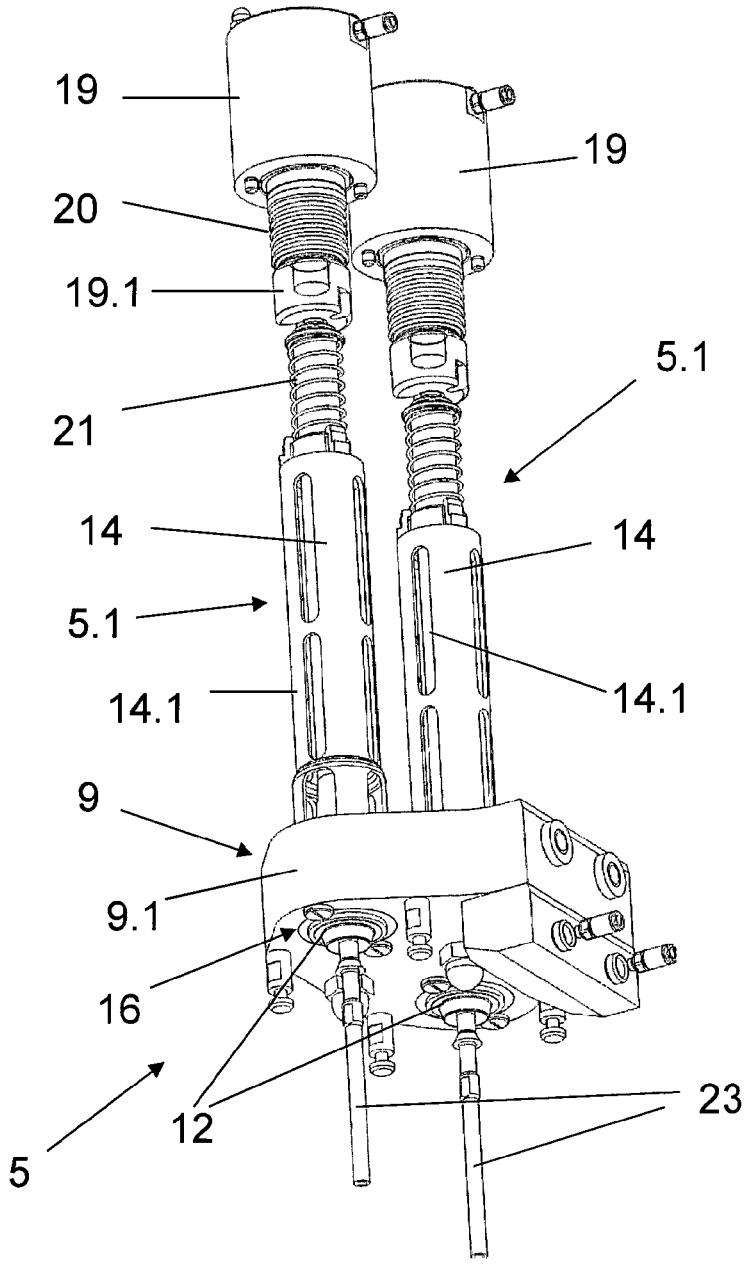

Each housing 14 is formed with several openings 14.1 at its circumferential wall, as shown in FIG. 7. The openings 14.1 permit passage of the liquid filling charge from the ring bowl 3.1 or, respectively, from the ring bowl interior 15 into the second filling channel 13, and via this into the first filling channel 11.

During operation of the filling machine 1, the ring bowl's interior 15 is partly filled with liquid filling charge. A gas chamber 15.1 thus forms above the filling charge level in the ring bowl 3.1. The gas chamber 15.1 is occupied by an inert gas under pressure, such as $CO_2$ gas. Below the gas chamber 15.1 is a lower liquid chamber 15.2. The openings 14.1 are in the area of the liquid chamber 15.2.

Referring to FIG. 8, each first filling channel 11 has a liquid valve 16. The liquid valve 16 comprises a valve plunger 17 that forms a valve body 18. The valve body 18 interacts with a valve seat in the first filling channel 11. By means of the valve plunger 17, the valve body 18 moves up and down axially along the filling element axis FA for the controlled opening and closing of the liquid valve 16.

The valve plunger 17 extends inside the housing 14 and is guided in or at this housing 14. Inside the ring bowl's interior 15, the valve plunger 17 is guided with an upper end out of the upper side of the housing 14, preferably sealed.

A quick-acting or plug-in coupling connects an upper end of the valve plunger 17 to an actuation plunger 19.1 of an actuation device 19. The actuation device 19 is outside the ring bowl interior 15 on an upper side of the ring bowl 3.1. Bellows 20 assist in guiding the actuation plunger 19.1 in a sealed manner through the upper side of the ring bowl 3.1. Examples of an actuation device 19 include a pneumatically actuated actuation device, which is put into operation by at least one electrically-actuated pneumatic valve in order to produce a controlled lifting movement of the valve plunger 17 in the filling element axis FA. The actuation devices 19 enable the liquid valves 16 to be independently controlled, or controlled separately from one another.

A spring 21 inside the ring bowl interior 15 actuates the valve plunger 17, and therefore the valve body 18. Preferably, the spring 21 is inside the gas chamber 15.1, which surrounds the valve plunger 17. The spring 21 urges the valve body 18 into a position that closes the valve 16.

In the embodiment shown, each valve plunger 17 is formed with a gas channel 22 coaxial with the filling element axis FA. The gas channel 22 continues beneath the valve body 18 downwards into a gas tube 23 that is arranged to be coaxial to the filling element axis FA, at the lower end of which the gas channel 22 is open.

The gas tube 23, which is surrounded by the annular filling charge dispensing opening 12 and which, during the filling of the respective container 2, extends into the container through the container opening, serves as the probe for determining the filling height of the charge. For this purpose, the upper end of the gas channel 22 opens into the gas chamber 15.1.

In additional valve 22.1 in the gas channel 22 opens and closes the gas channel 22. An example of such a valve 22.1 is a non-return valve. Such a valve opens for flow in a direction from the lower end of the gas tube 23 into the gas chamber 15.1, and closes for flow in the opposite direction.

Figure 9:
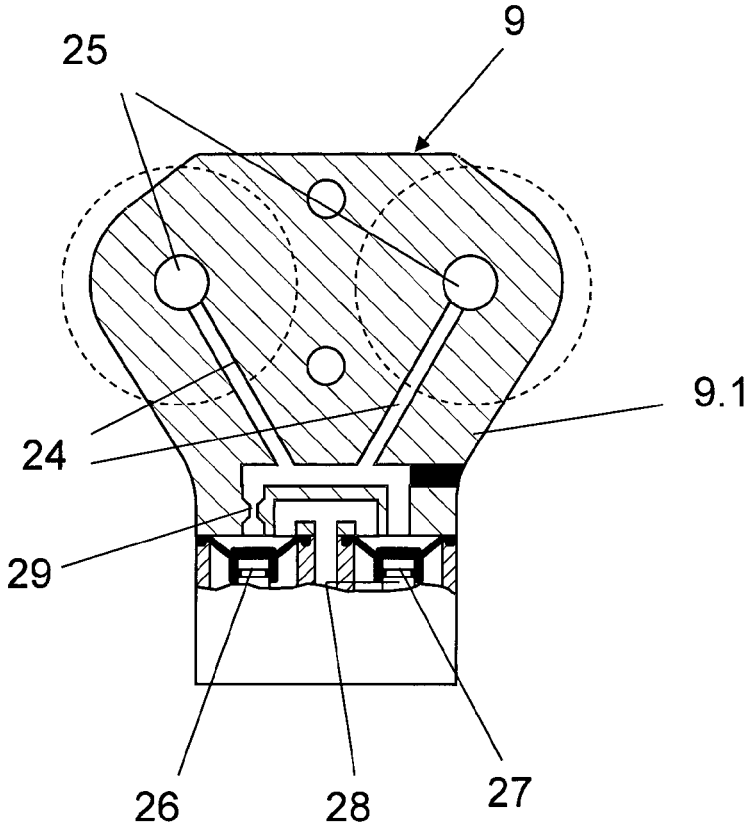
FIG. 9 is a simplified schematic representation of a section through an underpart of a filling element of one of the multiple filling-elements in the area of a control-valve unit comprising two control valves.

As FIGS. 8 and 9 show, controlled vapor and/or gas paths 24 are formed in the lower part 9 of the filling element, or in its housing 9.1. The controlled vapor and/or gas paths 24, are common to the individual filling elements 5.1 of each multiple filling-element 5. In each case, they open via holes 24 into the first filling channels 11 of the two individual filling elements 5.1 between the liquid valve 16 and the filling-charge dispensing opening 12.

First and second control valves 26, 27 are provided in the controlled vapor and/or gas paths 24. The first and second control valves 26, 27 connect the vapor and/or gas paths 24 in a controlled manner to a connection 28. The connection 28, in turn, connects to an under-pressure source or to a channel under vacuum of the filling machine 1. The first and second control valves 26, 27 are pneumatic control valves of a control-valve unit. In some embodiments, the first and second control valves 26, 27 are pneumatic cylinders. The first and second control valves 26, 27 are typically actuated by an electrically-actuated pneumatic valve of a control block, not shown. A choke 29, with a reduced flow cross-section, is in series with the first control valve 26.

With the filling machine 1, and with the multiple filling-elements 5 respectively, different filling methods for filling the containers 2 are possible. For example, it is possible to pressure fill the containers 2 arranged specifically in the sealing positions at the multiple filling-element 5 and at the individual filling elements 5.1. In this situation, the containers 2 are pre-tensioned by an inert gas from the gas chamber 15.1, after which the actual filling of the containers 2 takes place by opening the liquid valve 16 with the first and second control valves 26, 27 closed.

During filling, the gas tube 23 extends into the container 2. This enables it to serve as a probe for determining a filling height in the container 2. In particular, as the filling charge level rises in the container 2, it eventually immerses a lower end of the gas tube 23. Once this occurs, the further inflow of the filling charge into the container 2 automatically ends.

After the final closure of both liquid valves 16 of the multiple filling-element 5, the first control valve 26 opens. This results in simultaneous stress-relief of the two containers 2 arranged at the processing positions 4*a*, 4*b* of the multiple filling-element 5. Because of the choke 29, this stress relief takes place gently. This avoids foam formation.

In some cases, container-evacuation precedes the stress-relief. The container-evacuation takes place via the vapor and/or gas paths 24 with the first and second control valves 26, 27 open. In other cases, container-flushing precedes the stress-relief. The container-flushing uses inert gas from the gas chamber 15.1 via the gas channel 22 and also involves dispersal of the flushing gas out of the containers 2 via the vapor and/or gas paths 24 with the first and second control valves 26, 27 open.

Both container-evacuation and container-flushing take place simultaneously at the two processing positions 4*a*, 4*b* formed from the multiple filling-element 5. In order to attain the largest possible flow cross-section for this purpose, it is preferable that both first and second control valves 26, 27 be opened both during container-evacuation and during container-flushing.

It is assumed with regard to the foregoing description that the filling height is determined and controlled respectively by the gas tubes 23. However, other function elements can also be used for this. Examples include electric probes, and flow meters. These function elements are provided independently for each filling point 4*a*, 4*b*.

Special features of the filling machine 1 are that the processing positions 4*a*, 4*b* are formed by multiple filling-elements 5, that for each multiple filling-element 5 the function elements are provided in common for individual functions of the individual filling elements 5.1, 5.2, such as the first and second control valves 26, 27, further control valves for the vapor and/or gas paths 24, or further liquid paths, and that other function elements are provided separately for other functions, in particular for functions that relate to the filling height or filling quantity for each individual filling element 5.1, such as the liquid valve 16 and the elements that determine the filling height and/or filling quantity.

A further special feature is that the multiple filling-elements 5 are secured with their filling element underpart 9 directly on the underside of the ring bowl 3.1. The common function elements required for the common functions are then located in this filling element underpart 9. Other function elements of each multiple filling-element 5, in particular the function elements necessary for the separate functions, are at least in part provided in the bowl interior 15, and, if appropriate, on the upper side ring bowl 3.1, where they face away from the filling element underpart 9, such as the housing 14, the valve plunger 17 of the liquid valve, and the actuation elements 20.

As a result of the arrangement disclosed herein, and in particular, as a result of using the multiple filling-elements 5, substantial advantages arise. These advantages include savings that result from a reduced number of components, a reduction in required material, and a reduction in manufacturing costs.

In addition, further savings arise from having common fluid, vapor, or gas paths for the respective individual filling elements 5.1, from having fewer control valves, and from having a simpler electrical control system with fewer electronic components. The arrangement also reduces installation time because integrated modules can be pre-assembled and then installed as complete and fully functional structural units. In addition to this, it is also possible to carry out time-saving conversion of an existing filling machine 1 to use multiple filling-elements and/or other filling methods.

Thanks to the arrangement of a part of the function elements of the multiple filling-elements 5 inside the ring bowl 3.1, the arrangement described herein also results in a compact space-saving arrangement of the filling machine 1.

Figure 10:
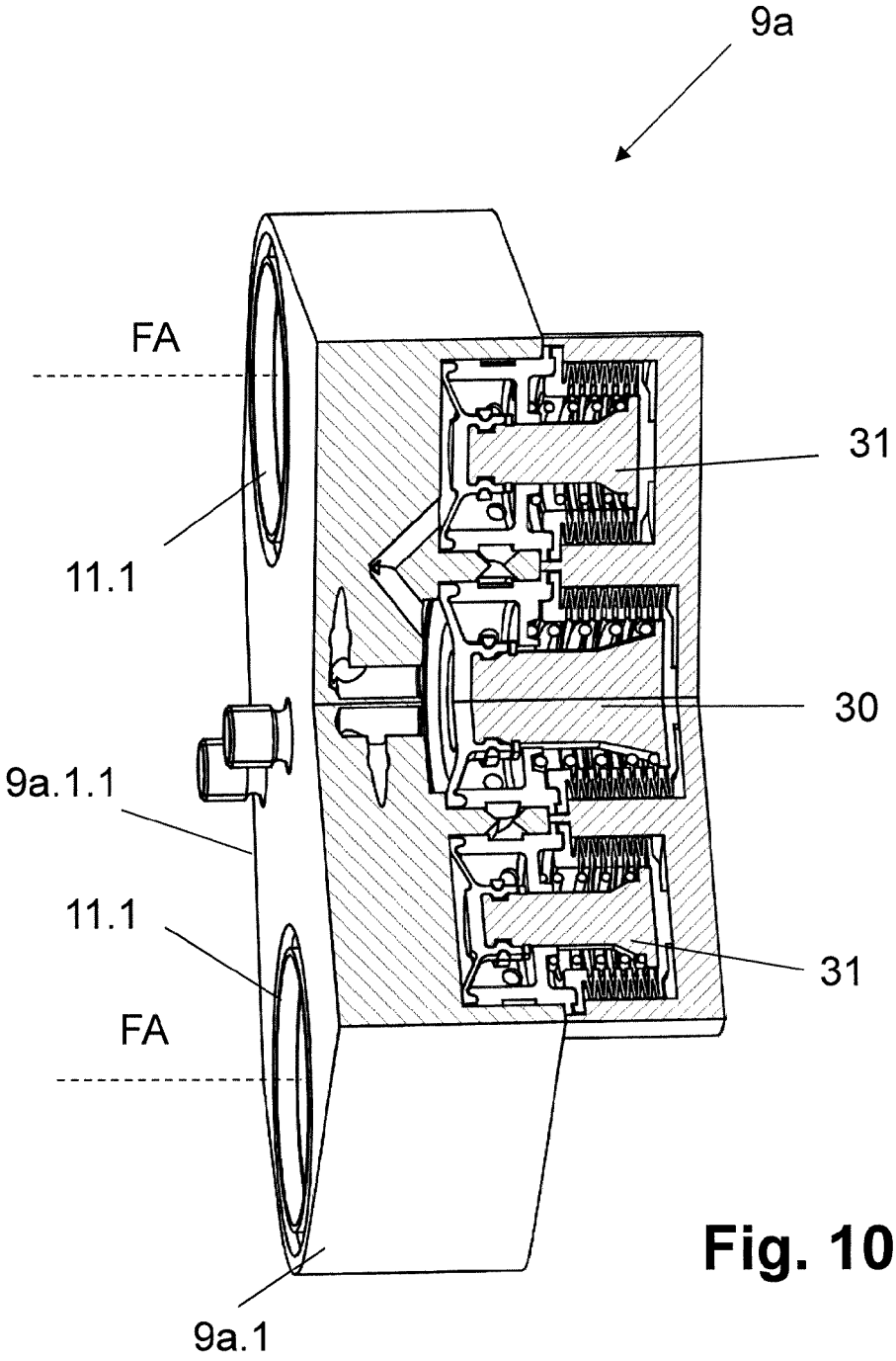
FIG. 10 is a perspective representation, also partially in section, of an underpart of a multiple filling-element, with a further embodiment of the invention, and specifically in a view rotated through 90° in relation to an installation state.
Figure 11:
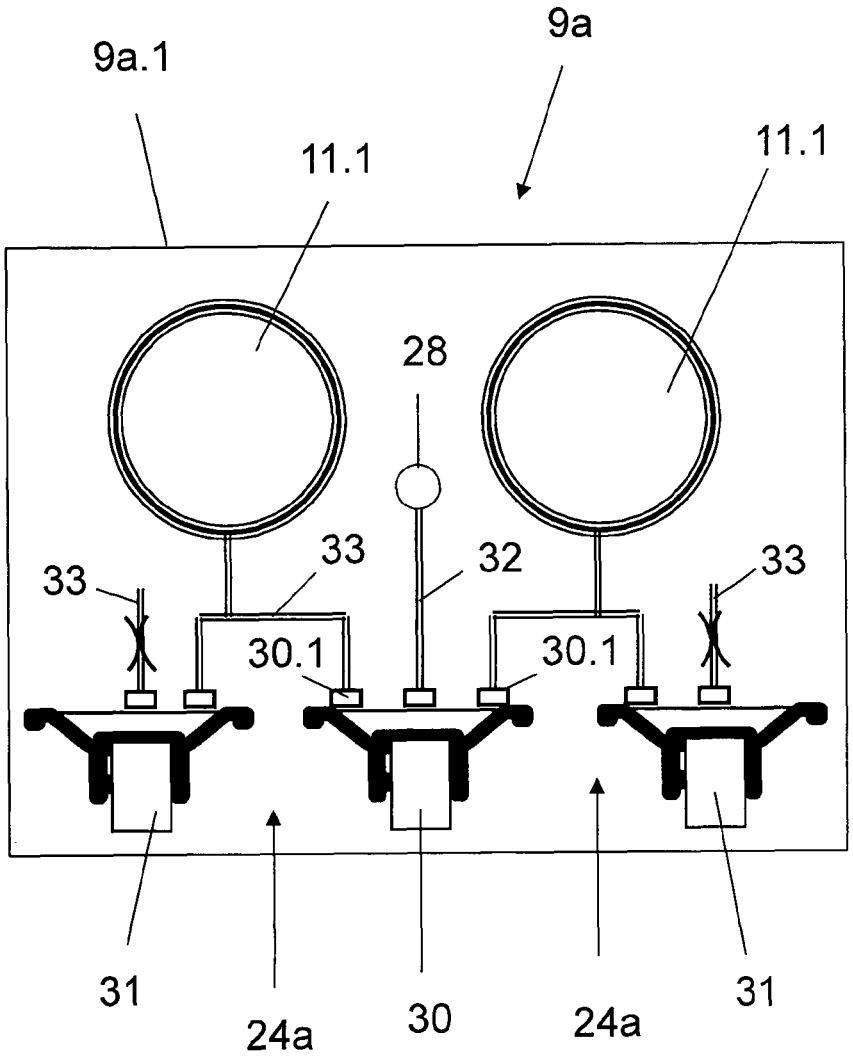
FIG. 11 is a schematic function representation of the underpart of the multiple filling-element from FIG. 10.

FIGS. 10 and 11 show an alternative filling element underpart 9*a*, that can be used instead of the filling element underpart 9 with the multiple filling-elements 5 of the filling machine 1. The alternative filling element underpart 9*a* has a flat housing 9*a*.1. In the installed state, the flat housing 9*a*.1 is secured by its upper side 9*a*.1.1 making use of at least one seal, not shown, to the underside 10 of the ring bowl 15, and specifically in such a way that the openings 11.1 provided in the housing 9*a*.1 and forming the filling channel 11, are arranged to be congruent with corresponding openings in the base of the ring bowl 15.

Provided in the housing 9*a*.1 are three pneumatically actuated control valves 30, 31, as well as gas channels forming gas paths. One of the valves is a common control valve 30 for both of the individual filling elements 5.1 of the multiple filling-element 5. The other two valves are individual control valves 31 provided separately for each individual filling element 5.1. The individual control valves 31 are constituent parts of corresponding controlled gas paths 24*a* that are provided separately for each individual filling element 5.1 of a multiple filling-element 5.

As shown in FIG. 11, the gas paths 24*a* are connected to a valve seat 30.1 of the common control valve 30, which is provided independently for each gas path 24*a*. In its open state, the common control valve 30 connects the connection 28 with the two gas paths 24*a* by way of a common gas channel 32 formed in the housing 9*a*.1. In its closed state, the common control valve 30 blocks not only the connection between the connection between the connection 28 and the gas paths 24*a*, but also separates the two gas paths 24*a* from one another.

The gas paths 24*a* and their branched gas channels 33 can be individually controlled by the control valves 31 and can be connected to a further gas channel 34 of the gas path 24, which is likewise formed in the housing 9*a*.1 and comprises, for example, a choke.

Figure 12:
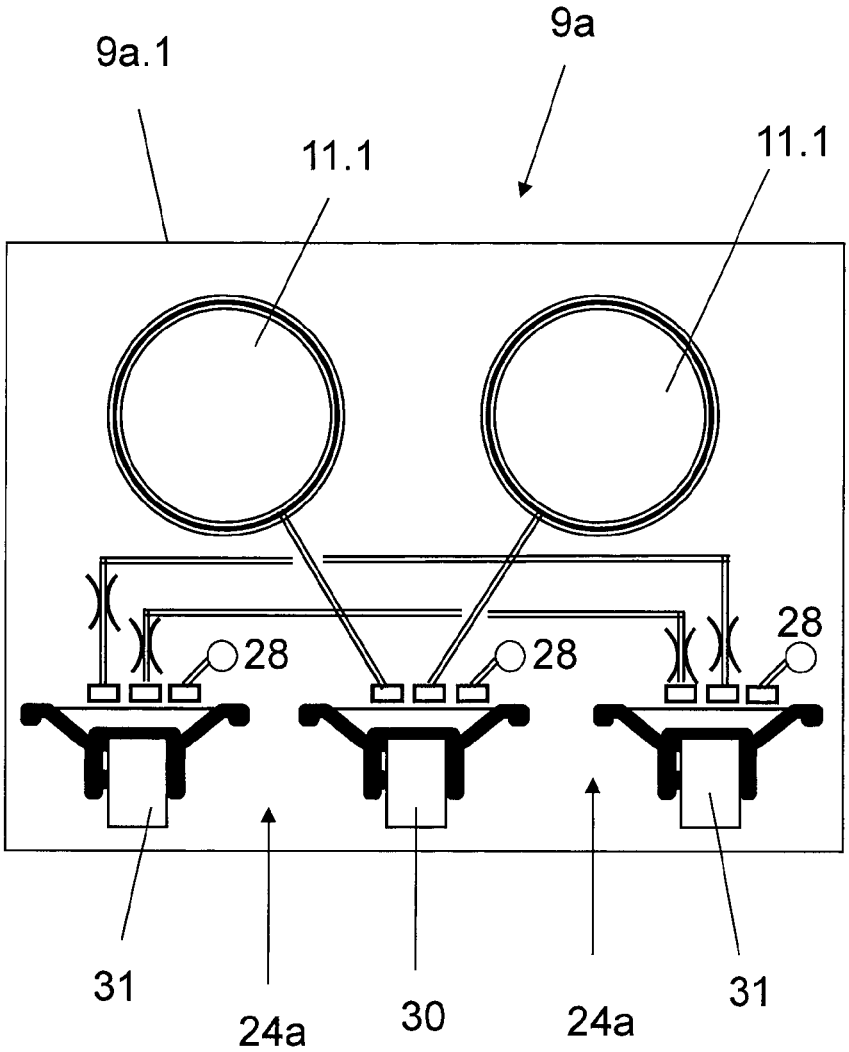
FIG. 12 is a schematic function representation of a particularly advantageous embodiment of an underpart of a multiple filling-element.

FIG. 12 shows a further embodiment of the present invention. The filling valve underpart 9*a* represented in FIG. 12 differs from the filling valve underparts disclosed thus far because additional gas paths and chokes are provided.

The embodiment shown in FIG. 12 is useful for avoiding problems that can arise if one of the bottles that is to be filled at a multiple filling-element breaks during handling or even during the actual filling.

To avoid adverse consequences of such breakage, a choke is arranged in one of the gas paths that lead from an opening 11.1 to a control valve 30, 31. The gas paths that lead from different openings 11.1 to a common control valve 30, 31 are designed in such a way, or are connected to the common control valve 30, 31 in such a way, that the gas paths are connected to one another only when the common control valve 30, 31 is opened. Conversely, if the common control valve 30, 31 is closed, then no connection exists between the gas paths. This means that different pressure conditions can also exist in the openings 11.1. For example, a filling pressure can exist in a first opening, while a second opening allocated to the same control valve 30, 31 is at ambient pressure since the bottle allocated to the second opening 11.1 has broken.

If the control valve 30, 31 is opened, the chokes arranged in the gas paths between the opening 11.1 and the control valve 30, 31 prevent pressure equalization between the openings 11.1. In particular, the chokes prevent too sharp a fall of pressure in the gas path or the opening 11.1 at which an intact container present, and therefore the reference pressure intended for the stage of the process still prevails. Advantageously, the control valves 30, 31 connect the allocated gas paths with at least one common collection channel or connection 28, which can be provided, for example, for the imposition of underpressure, or for the flushing or pre-tensioning.

The invention has been described in the foregoing on the basis of one embodiment. It is understood that numerous modifications and diversifications are possible, without departure from the inventive concepts on which the invention is based.

The invention claimed is:

1. An apparatus for filling containers with liquid filling-charge, said apparatus comprising a multiple filling-element, a circulating rotor, individual filling-elements, filling channels, filling-charge dispensing openings, independently controlled liquid valves, and a ring bowl, wherein said ring bowl forms an interior, wherein said ring bowl is provided at said rotor to provide said liquid filling-charge, wherein said multiple filling-element is arranged for installation on said circulating rotor, wherein said multiple filling-element comprises said individual filling-elements, wherein said multiple filling-element is formed for installation on an underside of said ring bowl, wherein each of said individual filling-elements comprises one of said filling channels, wherein each of said filling channels comprises one of said filling-charge dispensing openings, wherein each of said filling channels comprises one of said independently controllable liquid valves, wherein other function elements of said individual filling-elements are common to all individual filling-elements of said multiple filling-element, and wherein said other function elements are selected from the group consisting of controlled fluid paths, controlled liquid paths, gas paths, vapor paths, and control valves located on an element selected from the group consisting of liquid paths, gas paths, and vapor paths, said apparatus further comprising separate first and second paths, a control valve, and a structure selected from the group consisting of a common connection and a gas channel, wherein said paths are selected from the group consisting of gas paths and vapor paths, wherein said control valve has an open state and a closed state, wherein each of said individual filling-elements of said multiple filling-element comprises one of said paths, wherein, in said open state, said control valve connects said first and second paths with said structure, and wherein, in said closed state, said control valve separates said first and second paths from said structure and from each other.

2. The apparatus of claim 1, wherein said multiple filling-element comprises no more than two individual filling-elements.

3. The apparatus of claim 1, wherein said filling-charge dispensing openings, said liquid channels, and valve seats of one of said liquid valves and said function elements are provided in or at a filling-element underpart, and wherein said filling-element underpart is arranged for installation on said underside of said ring bowl.

4. The apparatus of claim 1, wherein said function elements are configured for arrangement in said interior, wherein said function elements are provided in each separately or independently for said individual filling-elements.

5. The apparatus of claim 1, wherein each of said individually controllable liquid valves comprises a valve body, a valve plunger, a valve seat, and an actuation device, wherein said valve body is provided at said valve plunger, wherein said valve body interacts with said valve seat, wherein said valve plunger extends at least part-way into said interior, wherein said valve plunger is connected to said actuation device, wherein said actuation device is provided on an upper side of said ring bowl outside said interior, and wherein said actuation device enables controlled opening and closing of said liquid valve.

6. The apparatus of claim 1, further comprising a gas channel, an additional valve, and a gas chamber, wherein said gas channel is open to said filling-charge dispensing opening, wherein said gas channel opens into said gas chamber via said additional valve, and wherein said gas chamber is formed in said interior.

7. The apparatus of claim 1, wherein said control valve comprises a first valve seat, a second valve seat, and a third valve seat, wherein said first valve seat is connected to said first path, wherein said second valve seat is connected to said second path, and wherein said third valve seat is connected to said structure.

8. The apparatus of claim 1, wherein each of said liquid valves comprises a valve seat, a valve plunger, and a valve body, wherein said valve body is provided at said valve plunger, wherein said valve body interacts with said valve seat, wherein said valve plunger is guided in or at an additional housing, wherein said housing is provided separately for each filling element at a filling-element underpart, wherein a side of said underpart projects above said housing, and wherein said side faces away from said filling-charge dispensing opening.

9. The apparatus of claim 8, further comprising a spring element, wherein said spring element is between said valve plunger and said additional housing, wherein said spring element pre-tensions said valve plunger and said valve body into one of a closed and open position of said liquid valve, and wherein said spring element is disposed in said interior.

10. The apparatus of claim 1, further comprising a filling machine having a vertical machine axis, wherein said circulating rotor is a rotor of said filling machine, wherein said circulating rotor rotates about said vertical machine axis, wherein said multiple filling-element is one of a plurality of identical multiple filling-elements disposed along a circumference of said rotor, each of which forms a filling point.

11. The apparatus of claim 10, wherein each of said filling points comprises a container-engagement structure and a lifting structure that corresponds to said container-engagement structure, wherein said container-engagement structure is selected from the group consisting of container carriers and centering elements, wherein said lifting structure is selected from the group consisting of a common lifting device and separate lifting devices, and wherein said container-engagement structure is movable along a filling-element axis by said lifting structure.

12. The apparatus of claim 10, wherein each of said individual filling-elements comprises a probe that is configured to extend into a container during filling thereof for controlling an amount of liquid filling-charge introduced into said container, wherein said probe comprises a gas tube that extends into a gas channel.

13. The apparatus of claim 10, and wherein parts of said multiple filling-elements are accommodated in said interior.

14. The apparatus of claim 13, wherein said parts are provided separately for said individual filling-elements.

15. The apparatus of claim 13, wherein said parts comprise function elements that are provided separately for said individual filling-elements.

16. The apparatus of claim 13, wherein each of said multiple filling-elements comprises an underpart, wherein each underpart comprises an independent housing for each individual filling-element of said multiple filling-element, wherein each individual filling-element extends into said interior, wherein further filling channels are formed in said individual filling-elements, wherein said further filling channels are connected to a filling channel in said filling-element underpart, and wherein said further filling channels are connected to said interior via openings.

* * * * *